United States Patent [19]

Kawakami et al.

[11] 4,432,792

[45] Feb. 21, 1984

[54] MATERIAL FOR STEEL WOOL

[75] Inventors: Heijiro Kawakami, Kobe; Sadayoshi Furusawa, Mitaka; Toyofumi Hasegawa; Hitoshi Sato, both of Kobe; Katsumasa Tanaka, Ono; Jiro Koarai, Kobe, all of Japan

[73] Assignee: Kabushiki Kaisha Kobe Seiko Sho, Kobe, Japan

[21] Appl. No.: 429,619

[22] Filed: Sep. 30, 1982

[30] Foreign Application Priority Data

Oct. 2, 1981 [JP] Japan ..... 56-157108

[51] Int. Cl.[3] ..... C22C 38/00

[52] U.S. Cl. ..... 75/123 R; 75/123 N; 75/124; 428/605

[58] Field of Search ..... 75/123 R, 123 N, 123 D, 75/124 B; 148/36; 428/605

[56] References Cited

U.S. PATENT DOCUMENTS 2,361,672 10/1944 Winkler ..... 428/605

4,026,727 5/1977 Finkl et al. ..... 75/124 BB

*Primary Examiner*—L. Dewayne Rutledge

*Assistant Examiner*—Debbie Yee

*Attorney, Agent, or Firm*—Oblon, Fisher, Spivak, McClelland & Maier

[57] ABSTRACT

A material for steel wool is disclosed which essentially consists of 0.05 to 0.20% of C, up to 0.10% of Si, 0.50 to 1.30% of Mn, 0.035 to 0.10% of P, up to 0.04% of S,0.05 to 0.15% of N and the balance Fe. In this material, $Al_2O_3$ inclusions with sizes not smaller than 3 microns are suppressed to a level not greater than 20 ppm and when the content of the $Al_2O_3$ inclusions (3 microns and over) is in the range of 5 to 20 ppm, $Al_2O_3$ inclusions with a size ranging from 3 to 10 microns is contained in an amount not smaller than 30% of the total content of $Al_2O_3$ inclusions with sizes not smaller than 3 microns.

1 Claim, 3 Drawing Figures

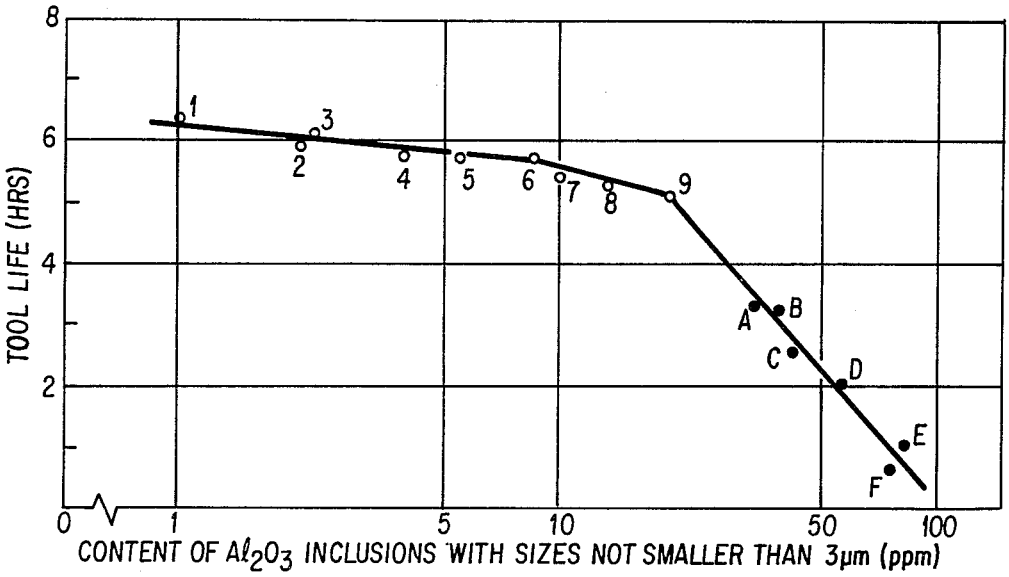
FIG. 1
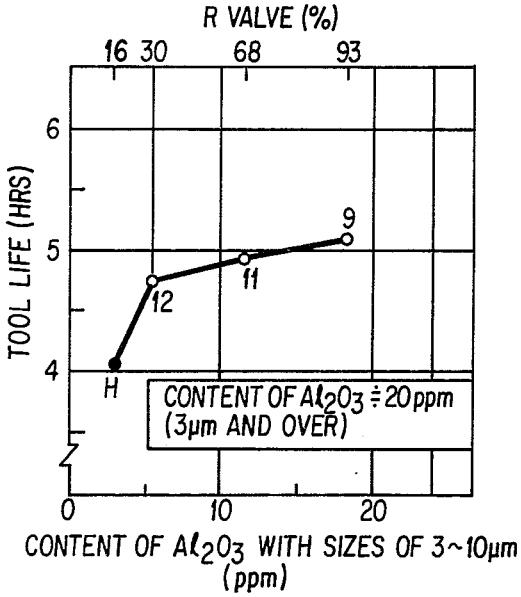
FIG. 2(a) SIZE COMPONENT OF Al2O3 AND TOOL LIFE (CASE 1)
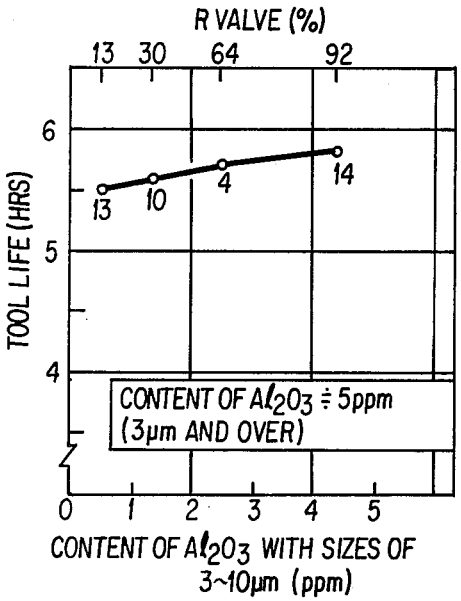
FIG. 2(b) SIZE COMPONENT OF Al2O3 AND TOOL LIFE (CASE)

MATERIAL FOR STEEL WOOL

BACKGROUND OF THE INVENTION

1. Field of the Invention

This invention relates to steel wools and more particularly, to a material for steel wool which is imparted with excellent ability of being machined.

2. Description of the Prior Art

In general, steel wools are fabricated through a processing step in which a steel wire is continuously machined in a depth of several microns along the length of the wire by the use of a tool having a specific shape of groove, thus presenting various problems. That is, the problems involved are:

(1) A steel wool is not obtained continuously by machining and dust and broken pieces are formed in large amounts by breakage, causing the yield and workability to lower;

(2) The life of the tool becomes short because of the machining of steel wire, e.g. an ordinary life of 3 to 4 hours is reduced to less than 2 hours; and (3) The tool life abruptly reduces when the machining speed is increased.

We have made extensive studies on the problems involved in the fabrication of steel wool and, as a result, found that these problems are chiefly caused by nonmetallic inclusions and particularly $Al_2O_3$ present in the steel wire. In order to fabricate a steel wool which is uniform and continuous without breakage of chips and also to reduce the wearing-out of a machining tool, it is necessary that not only components contained in the steel wool should properly be determined with their controlled contents, but also $Al_2O_3$ as a nonmetallic inclusion should be regulated in amounts.

SUMMARY OF THE INVENTION

It is accordingly an object of the present invention to provide a material for steel wool which overcomes the disadvantages of the prior art.

It is another object of the invention to provide a material for steel wool which ensures fabrication of a steel wool of high quality and a prolonged life of machining tool.

It is a further object of the invention to provide a material for steel wool which has a limited content of aluminium oxide inclusions.

The above objects can be achieved by a material for steel wool which consists essentially of 0.05 to 0.20% of C, up to 0.10% of Si, 0.50 to 1.30% of Mn, 0.035 to 0.10% of P, up to 0.04% of S, 0.005 to 0.015% of N and the balance of Fe, $Al_2O_3$ inclusions in the material having sizes not smaller than 3 microns being so controlled that their content is suppressed to a level not greater than 20 ppm and when their content of the $Al_2O_3$ inclusions is within the range of 5 to 20 ppm, $Al_2O_3$ inclusions having a size ranging from 3 to 10 microns are not less than 30% of the total content of the $Al_2O_3$ inclusions with sizes not smaller than 3 microns.

BRIEF DESCRIPTION OF THE DRAWINGS

FIG. 1 is a graphical representation of a relation between the content of $Al_2O_3$ inclusions having sizes not smaller than 3 microns and the tool life; and FIGS. 2(*a*) and 2(*b*) are, respectively, graphical representations of a relation between the content of $Al_2O_3$ inclusions having a size of 3 to 10 microns and the tool life for two different contents of total $Al_2O_3$ with sizes not smaller than 3 microns. FIG. 2(*a*) is the case with total content of $Al_2O_3$ (3 μm and over) about 20 ppm, and FIG. 2(*b*) is the case with total content of $Al_2O_3$ (3 μm and over) not greater than 5 ppm.

DETAILED DESCRIPTION OF THE INVENTION

The components of the material for steel wool and their contents according to the present invention are described.

C is a carbide-forming element and serves to form a hard Fe C carbide, so that although it is necessary to reduce its content to an extent as small as possible from the standpoint of machinability, carbon is an essential element which imparts a suitable level of hardness to steel wool. This effect is hardly shown when the content of C is less than 0.05% whereas a content exceeding 0.20% results in an excess of hardness, making it difficult to machine such a hard steel. Accordingly, the content of C should be in the range of 0.05 to 0.20%.

Si will form a harmful inclusion, $SiO_2$, which acts to wear out a cutting tool or machining. Accordingly, the content of Si should be in the range up to or not larger than 0.10%.

Mn is an element which imparts a level of hardness to ferrites and a suitable content of Mn is in the range of 0.50 to 1.30%.

P is an interstitial element similar to N and forms an intestitial solid solution into ferrite, serving to embrittle the ferrite. Therefore, P is usually employed in a large amount with the case of free-cutting steels. However, steel wool should be formed as a continuous chip and thus P should not be contained in large amounts. Accordingly, the content of P is in the range of 0.035 to 0.10%.

S should not be rather contained because breakage of a chip is apt to occur though S serves to improve the machinability to an extent. However, when the content is in a normally present range of, say, below 0.04%, little or no adverse influence on the fabrication of a continuous chip of steel wool is produced. Accordingly, the content of S is in the range up to 0.04%.

N forms a solid solution in α-Fe as an interstitial element and acts to increase the hardness of the ferrite itself, ensuring good machinability and improving or increasing the elastic limit because of the high hardness. For instance, at the time of repeated use such as of a steel wool scrubbing brush, the elasticity is enhanced so that the sagging of the brush does hardly take place. However, the content in excess will cause considerable brittleness. Accordingly, the content of N is in the range of 0.005 to 0.015%.

In the practice of the invention, the size and content of $Al_2O_3$ inclusions are defined within certain ranges. This is for the following reason: $Al_2O_3$ is a very hard material and if it is present in a steel wire, a machining tool is so considerably abraded at the time of machining for the production of steel wool that the tool life becomes shortened appreciably.

We have also found that the size of $Al_2O_3$ inclusions gives a great influence on the tool life and the quality of steel wool. That is, $Al_2O_3$ inclusions having sizes below 3 microns do not give an appreciable influence on the tool life but when $Al_2O_3$ inclusions having sizes not smaller than 3 microns are contained in an amount greater than 20 ppm in steel, the wearing of the tool becomes considerable, so that not only the tool life is lowered to a substantial extent, but also the steel wool becomes non-uniform in shape and discontinuous with dust and pieces being formed in large amounts. Accordingly, $Al_2O_3$ inclusions having sizes not smaller than 3 microns should be contained in an amount not greater than 20 ppm.

Moreover, even though the content of $Al_2O_3$ inclusions having sizes not smaller than 3 microns is not greater than 20 ppm, a content of $Al_2O_3$ inclusions having sizes of 3 to 10 microns within a range of 5 to 20 ppm, which content being less than 30% of the total $Al_2O_3$ inclusion (3 μm and over) content, will shorten the tool life. If the content of $Al_2O_3$ inclusions (3 μm and over) is less than 5 ppm, the size of the inclusions is almost irrespective of the tool life. Accordingly, when the content of $Al_2O_3$ inclusions having sizes not smaller than 3 microns is in the range of 5 to 20 ppm, a content of $Al_2O_3$ inclusions having sizes ranging from 3 to 10 microns should be not less than 30% of the total content of $Al_2O_3$ inclusions with sizes not smaller than 3 microns.

The $Al_2O_3$ inclusions are derived from several sources including Al originally present in steel as an impurity which is converted into $Al_2O_3$, $Al_2O_3$ which is contained in steel by erosion of refractories, and the like. The content of $Al_2O_3$ should be controlled within the range defined before by supressing a content of Al to an extent as small as possible in the course of the manufacture of steel wire.

It is almost impossible to reduce the content of $Al_2O_3$ inclusions to a level of zero. However, the steel wire of the present invention in which the content of $Al_2O_3$ inclusions is controlled within a certain range ensures a prolonged tool life about 1.5 times as long as steel wires in which the content of $Al_2O_3$ is not controlled, coupled with the possibility of high speed machining or cutting.

Additionally, with the machining of steel wool, the cutting depth is in the order of several microns different from the case of ordinary machining. This is why the steel wire of the invention in which the content of $Al_2O_3$ inclusions having sizes over 3 microns involves only a reduced degree of breakage of chip and a reduced amount of powder and dust produced on machining. Further, a reduced degree of wearing-out of the tool permits the resulting steel wool to become uniform in shape.

The content of the $Al_2O_3$ inclusion is determined by a residue analysis in which an amount of $Al_2O_3$ is calculated from an amount of Al which is extracted from acid-insoluble $Al_2O_3$ inclusion and $Al_2O_3$-base inclusions (such as, for example, $MnO.Al_2O_3$, $3Al_2O_3.2SiO_2$ and the like).

The present invention is particularly described by way of examples and comparative examples.

EXAMPLE 1

80 tons of each of steels having components and their contents as indicated in Table 1 was made in a converter and rolled into a 115 mm square steel billet, followed by rolling into a wire rod with a diameter of 8.0 mm. This wire rod was subjected to the air-patenting and drawn into a wire having a diameter of 3.1 mm.

This steel wire of 3.1 mm in diameter was machined to give a steel wool, after which the relation between the content of an $Al_2O_3$ inclusion having a size not smaller than 3 microns and the life of the tool was checked.

The results are shown in FIG. 1.

TABLE 1

| | Chemical Components | | | | | | Amount of $Al_2O_3$ (ppm) | | |
|---|---|---|---|---|---|---|---|---|---|
| No. | C | Si | Mn | P | S | N | ≧3 microns | 3-10 microns | R Value* (%) |
| 1 | 0.16 | 0.02 | 1.02 | 0.069 | 0.019 | 0.0090 | 1.0 | 0.4 | 40 |
| 2 | 0.14 | 0.04 | 0.99 | 0.075 | 0.021 | 0.0097 | 2.1 | 0.9 | 43 |
| 3 | 0.16 | 0.03 | 0.92 | 0.072 | 0.016 | 0.0095 | 2.3 | 0.8 | 35 |
| 4 | 0.17 | 0.03 | 0.93 | 0.084 | 0.025 | 0.0090 | 3.9 | 2.5 | 64 |
| 5 | 0.15 | 0.02 | 1.01 | 0.070 | 0.024 | 0.0098 | 5.5 | 3.6 | 65 |
| 6 | 0.17 | 0.02 | 0.94 | 0.069 | 0.019 | 0.0092 | 8.6 | 7.8 | 91 |
| 7 | 0.18 | 0.02 | 0.94 | 0.065 | 0.024 | 0.0100 | 9.8 | 5.6 | 57 |
| 8 | 0.16 | 0.03 | 0.98 | 0.077 | 0.026 | 0.0093 | 13.5 | 10.4 | 77 |
| 9 | 0.16 | 0.02 | 0.97 | 0.074 | 0.017 | 0.0097 | 19.7 | 18.4 | 93 |
| A | 0.16 | 0.02 | 1.09 | 0.074 | 0.022 | 0.0100 | 32.5 | 10.1 | 31 |
| B | 0.17 | 0.03 | 1.07 | 0.083 | 0.020 | 0.0090 | 38.1 | 9.0 | 28 |
| C | 0.14 | 0.04 | 1.06 | 0.068 | 0.023 | 0.0104 | 42.0 | 15.1 | 36 |
| D | 0.15 | 0.03 | 1.03 | 0.072 | 0.020 | 0.0090 | 55.8 | 28.5 | 51 |
| E | 0.17 | 0.04 | 1.00 | 0.071 | 0.025 | 0.0100 | 82.3 | 32.1 | 39 |
| F | 0.15 | 0.02 | 0.99 | 0.084 | 0.019 | 0.0091 | 75.7 | 32.6 | 43 |

$$*\text{R value} = \frac{\text{Content of } Al_2O_3 \text{ inclusions with a size of 3 to 10 microns}}{\text{Content of } Al_2O_3 \text{ inclusions with sizes not smaller than 3 microns}} \times 100\ (\%)$$

As will be apparent from FIG. 1, when the $Al_2O_3$ inclusions with sizes not smaller than 3 microns are contained in an amount not greater than 20 ppm, the steels of the invention exhibit a prolonged tool life of more than 1.5 times as long as those of the comparative steels.

EXAMPLE 2

Steel materials having such compositions as shown in Table 2 were each processed in the same manner as in Example 1 to give a steel wire, which was then machined into a steel wool. These wires were used to determine the relation between the ratio (R value) of a content of $Al_2O_3$ inclusions with a size of 3 to 10 microns to a content of all the $Al_2O_3$ inclusions with sizes not smaller than 3 microns and the tool life.

The results are shown in FIG. 2(*a*) and FIG. 2(*b*).

TABLE 2

| No. | Chemical Components C | Si | Mn | P | S | N | Amount of $Al_2O_3$ (ppm) ≧3 microns | 3–10 microns | R Value (%) |
|---|---|---|---|---|---|---|---|---|---|
| 10 | 0.15 | 0.04 | 1.00 | 0.081 | 0.022 | 0.0101 | 4.7 | 1.4 | 30 |
| 4 | 0.17 | 0.03 | 0.93 | 0.084 | 0.025 | 0.0090 | 3.9 | 2.5 | 64 |
| 14 | 0.18 | 0.02 | 0.90 | 0.067 | 0.024 | 0.0100 | 4.8 | 4.4 | 92 |
| 13 | 0.14 | 0.03 | 1.08 | 0.080 | 0.027 | 0.0099 | 4.0 | 0.5 | 13 |
| 11 | 0.15 | 0.04 | 0.98 | 0.082 | 0.022 | 0.0103 | 17.1 | 11.6 | 68 |
| 12 | 0.17 | 0.01 | 0.95 | 0.071 | 0.020 | 0.0095 | 18.0 | 5.4 | 30 |
| 9 | 0.16 | 0.02 | 0.97 | 0.074 | 0.017 | 0.0097 | 19.7 | 18.4 | 93 |
| H | 0.14 | 0.04 | 1.03 | 0.083 | 0.023 | 0.0110 | 19.5 | 3.2 | 16 |

As will be apparent from FIG. 2(*a*) and FIG. 2(*b*), when the R value is lowered, the tool life becomes short even though the content of the $Al_2O_3$ inclusions with sizes not smaller than 3 microns is in the range not greater than 20 ppm. This becomes pronounced in case where the content of the $Al_2O_3$ inclusions with sizes over 3 microns, inclusive, are in the vicinity of 20 ppm. When the R value is below 30%, the tool life greatly lowers. In this connection, if a content of the $Al_2O_3$ inclusions with sizes not smaller than 3 microns is less than 5 ppm, the R value does not give any appreciable influence on the tool life.

From the above, it will be noted that when the content of the $Al_2O_3$ inclusions with sizes not smaller than 3 microns is not less than 5 ppm and large-size $Al_2O_3$ inclusions are contained in great amounts, the tool is worn out heavily.

This is why the steel of the invention is so controlled that a content of $Al_2O_3$ inclusions with sizes not smaller than 3 microns is suppressed to a level not larger than 20 ppm and when the content of the $Al_2O_3$ inclusions is in the range of 5 to 20 ppm, a content of $Al_2O_3$ inclusions with sizes ranging from 3 to 10 microns is in the range not smaller than 30% of the total content of the $Al_2O_3$ inclusions with sizes not smaller than 3 microns.

The foregoing description sets forth the preferred embodiment of the invention. Other modifications may occur to those skilled in the art which will come within the scope and spirit of the appended claims.

What is claimed is:

1. A material for steel wool essentially consisting of 0.05 to 0.20% of C, up to 0.10% of Si, 0.50 to 1.30% of Mn, 0.035 to 0.10% of P, up to 0.04% of S, 0.005 to 0.015% of N, and the balance of Fe, $Al_2O_3$ inclusions with sizes not smaller than 3 microns being so controlled that their content is suppressed to a level not greater than 20 ppm of the total content of the material for steel wool and when the content of the $Al_2O_3$ inclusions with sizes not smaller than 3 microns is within the range of 5 to 20 ppm, $Al_2O_3$ inclusions having a size ranging from 3 to 10 microns are not less than 30% of the total content of the $Al_2O_3$ inclusions with sizes not smaller than 3 microns.

* * * * *

UNITED STATES PATENT AND TRADEMARK OFFICE

CERTIFICATE OF CORRECTION

PATENT NO. : 4,432,792

DATED : FEBRUARY 21, 1984

INVENTOR(S) : HEIJIRO KAWAKAMI ET AL

It is certified that error appears in the above-identified patent and that said Letters Patent is hereby corrected as shown below: On the title page:

In the Abstract:

Line 3, change "0.05" to -- 0.005 --;

Line 4, change "0.15%" to -- 0.015% --.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*